United States Patent [19]

Soga et al.

[11] Patent Number: 4,605,016

[45] Date of Patent: Aug. 12, 1986

[54] PROCESS FOR PREPARING TOBACCO FLAVORING FORMULATIONS

[75] Inventors: Kiyomi Soga, Ayase; Nobuyoshi Tenjin; Hiroyuki Tohira, both of Odawara; Naoyoshi Ninomiya, Hiratsuka; Yasuhiro Nishikata, Fujisawa, all of Japan

[73] Assignee: Japan Tobacco, Inc., Japan

[21] Appl. No.: 632,874

[22] Filed: Jul. 20, 1984

[30] Foreign Application Priority Data

Jul. 21, 1983 [JP] Japan ..... 58-131973

[51] Int. Cl.[4] ..... A24B 3/18; A24B 15/18

[52] U.S. Cl. ..... 131/297; 131/298; 131/275

[58] Field of Search ..... 131/297, 298, 275

[56] References Cited

U.S. PATENT DOCUMENTS 3,616,801 11/1971 Hind ..... 131/297

4,364,401 12/1982 Keritsis ..... 131/298

*Primary Examiner*—Y. Harris-Smith

*Attorney, Agent, or Firm*—Lowe, Price, LeBlanc, Becker & Shur

[57] ABSTRACT

A new process for preparing a tobacco flavoring formulation is provided. In this process, tobacco leaves are extracted with cold water 0°-10° C. in a quantity at most five times as much as the amount thereof, an extracted liquid obtained by solid-liquid separation is concentrated at a temperature of 30°-50° C. to a solute concentration of 25-35%, and the thus obtained concentrated extract is compounded with a polyvalent alcohol into said formulation.

4 Claims, No Drawings

PROCESS FOR PREPARING TOBACCO FLAVORING FORMULATIONS

BACKGROUND OF THE INVENTION

The present invention relates to a process for preparing tobacco flavoring formulations for adding the flavor peculair to the kind of tobacco to tobacco products simultaneously with supression of the unsatisfactory peculiarity thereof, using good tobacco plants as the raw material.

During the process of drying leaf tobacco, its ingredients are subjected to fermentation and chemical action and, hence, to hydrolysis and oxidation. As a result, such ingredients are converted to the flavor ingredients peculiar to the kind of tobacco. Although there is a difference from kind to kind, leaf tobacco produces a sufficient flavor through an aging period in which it is subjected to accumulated fermentation or barreled for 1–2 years. In general, tobacco flavorings serve to enrich the flavor of tobacco by imparting thereto the flavor of their own, and provide tobacco products which suit comsumer's taste.

On the other hand, it is likely that leaf tobacco produced in Japan possesses unsatisfactory peculiarities such as bad smell and taste and, thus, are of deteriorated quality due to an increase in the output per unit area or weather conditions during cultivation, soil conditions, excessive fertilization and other factors.

In view of health-related concerns, there is recently a demand for low-nicotine and -tar tobacco products.

A part of the unsatisfactory ingredients of deteriorated tobacco leaves can be removed by using water, air and heat, with which most raw materials are treated. However, such procedures tend to weaken the flavor of tobacco. Low-nicotine and -tar products or sheet tobaccos using a large amount of vein material are also disadvantageous in that they are lacking in the flavor characteristic of tobacco. Some proposals have been made for preparing tobacco flavorings for adding the flavor characteristic of tobacco to materials lacking in the flavor of tobacco. For example, Japanese Patent Laid-Open Publication No. 51-133496 discloses that pre-treated tobacco leaves are extracted with water or a hydrophilic organic solvent at from normal temperature to 80° C., an extracted liquid from which solid matters have been removed is concentrated under reduced pressure into sauce having a solute concentration of about 50%, and the thus obtained sauce is diluted and added to tobacco products for flavoring.

However, in order to prevent decomposition and dissipation of the flavor ingredients present in the starting tobacco leaves, it is desired that, in the process of extraction and concentration, they be treated at a low temperature while reducing as much as possible the amount of heat applied thereto, thereby extracting the water-soluble flavor ingredients of their own. It has also been found that the addition of the foregoing sauce having a solute concentration of about 50%, which has been diluted, introduces no appreciable improvements into the scent of tobacco and the quality of smoke.

U.S. Pat. No. 3,316,919 discloses that tobacco leaves are extracted with a cold solvent such as cold water by gravity filtration, and the thus extracted liquid is powderized by rapid freezing and drying, whereby a powdery flavor ingredient is obtained without causing decomposition thereof. That powder is added to tobacco products in an amount of 5 to 10 weight % for increased flavoring.

In this case, however, no sufficient results are obtained, unless a relatively large amount of that powdery flavoring is added.

SUMMARY OF THE INVENTION

In consequence of studies made of efficient extraction of tobacco flavor ingredients with water, the present inventors have found that effective flavor ingredients can be obtained by extraction with water and concentration by evoporation at a lower temperature.

More specifically, the present invention provides a process for preparing a tobacco flavoring formulation, which is characterized in that tobacco leaves are extracted with cold water of 0°–10° C. in a quantity at most five times as much as the amount thereof, an extracted liquid obtained by solid-liquid separation is concentrated at a temperature of 30°–50° C. to a solute concentration of about 30%, and the thus obtained concentrated extract is compounded with a polyvalent alcohol into said formulation.

DETAILED DESCRIPTION OF THE INVENTION

In what follows, the process according to the present invention will be described in further detail.

The starting material for the tobacco flavoring formulations of the invention may be good tobacco plants just after harvesting or purchase or after aging. That material is dried to have a moisture content of about 7 to 13% by weight of water therein, partly or wholly crushed and sieved at most five times, preferably three times, as much as the amount thereof, followed by extraction of a water-soluble flavor ingredient under gentle agitation for preventing any local heating from taking place. Extraction is carried out using a dipping type extractor and cold water of 0°–10° C., preferably 5° C. in view of quality and process, and is completed at that temperature within a short time period of 3–10 minutes. Subsequently, the extracted liquid is separated from the residue by means of a centrifuge, and is concentrated by means of an evaporator constructed of glass or of the externally heating type. Concentration is carried out under reduced pressure at a temperature of no higher than 50° C. to prevent decomposition and dissipation of the flavor ingredient, thereby to obtain a solute concentration of about 30%. Even when concentration is effected at such a low temperature, it is desired that an effective temperature difference be no higher than 10° C. and a concentration time be within 90 minutes. This is because the flavor ingredient may likely decompose and dissipate, when the effective temperature difference is increased and the heating time is extended.

Further increases in the extraction temperature or further extension of the extraction time causes weakening of the flavor peculiar to the kind of tobacco used and deterioration in the flavor quality. Further increases in the concentration temperature or the concentration to be achieved, or alternatively further extension of the concentration time also causes weakening of the flavor peculiar to the kind of tobacco used and generation of bitter and pungent tastes.

As mentioned above, according to the process of the present invention, extraction and concentration are effected within a short time of period at a low temperature, while reducing the amount externaceous heat as much as possible, thereby obtaining a flavor-enriched formulation.

The concentrated extract prepared according to the foregoing process involves difficulty in long-term preservation, since it has a moisture content of as high as about 70%, and is apt to undergo a change in quality and deteriorate. For that reason, the concentrated extract is mixed with a polvalent alcohol such as glycerin or propylene glycol in a quantity at least 0.5 to 10 times by weight the amount thereof, whereby the dissipation by volatilization and evaporation of the flavor ingredient is prevented simultaneously with the prevention of deterioration and changes in quality.

The tobacco leaves used in the present invention may be pre-treated by drying, conditioning, fermentation and the like.

In order to increase further the effect of the tobacco flavoring formulation according to the present invention, it is diluted about 2–20 times with water, and the thus diluted formulation is added to the tobacco products in a quantity of about 0.0005–0.1% with respect to the weight thereof, as calculated in terms of the extracted solute (viz., in a formulation to tobacco product weight ratio of 0.002–0.04%). Thus, even slight amounts of the foregoing flavoring formulation add further tobacco-like flavor to low-nicotine and -tar products without increasing the nicotine content of smoke, and give a sufficient feeling of satisfaction to a smoker.

The flavoring formulations according to the present invention may be mixed with other water- or alcohol-soluble flavorings for tobacco.

The tobacco flavoring formulations according to the present invention can be added to various tobacco products including leaf tobacco, tobacco vein puff tobacco, sheet tobacco and various man-made tobacco or blends thereof for improving the flavor and taste thereof.

Since the tobacco flavoring formulations according to the present invention may be based on at least two different raw materials, it may be added to vein or cut tobacco in any point of the process of tobacco production.

The process of the present invention will now be explained in great detail with reference to the following non-restrictive examples.

EXAMPLE 1

In an extractor, 100 grams of Burley type ABR-No. 8 produced in U.S.A. were extracted under manual agitation for 10–20 minutes with water of 5°–80° C. in quantities 1–5 times by weight the amount of the raw material. Thereafter, the extracted liquid was separated from the residue by means of a centrifuge. In a rotary evaporator, the thus obtained liquid was concentrated under reduced pressure at a temperature of 40° C. and with an effective temperature difference of 10° C., thereby obtaining a concentrated extract having a solute concentration of about 30%.

The concentrated extract was diluted 10 times with water. The diluted liquid was uniformly sprayed onto a cut tobacco sheet made by a paper-making process in a proportion of 33 g/kg (0.1% as solute concentration), said sheet having a smaller degree of tobacco-like flavor and being somewhat ill-tasting, and allowed to stand overnight in a conditioning room of 20° C. and 60% RH. The thus conditioned tobacco was wound with paper into sample cigarettes having a length of 70 mm and a circumference of 26 mm. On the other hand, flavoring-free tobacco was wound with paper into a control cigarette.

Table 1 shows the extraction conditions (temperature/solid-to-liquid ratio/time) and the amount of liquid as well as the results of organoleptic tests relying upon two-point comparison, which were conducted by 20 professional panelists.

Of the figures given in Table 1, zero (0) indicates that the samples are identical with the control, plus one, two and three (±1, 2 and 3) show that the samples are slightly, considerably and extremely superior to the control, and minus one, two and three (−1, 2 and 3) indicate that the samples are slightly, considerably and extremely inferior to the control.

TABLE 1

| Extract Conditions | | | Extracted Liquid | | Concentrated Extract | | Estimation (average) | | |
|---|---|---|---|---|---|---|---|---|---|
| Temp. | Solid/ Liquid Ratio | Time | Concentration | Amount of Liquid | Concentration | Amount of Liquid | Scent | Taste | Peculiarity |
| Flavoring-free Sample | | | | | | | 0 | 0 | 0 |
| 5° C. | 1 | 10 min | — | — | — | — | — | — | — |
| 5 | 3 | 10 | 6.2% | 222 g | 29.7% | 44.9 g | +2.6 | +2.2 | +1.7 |
| 5 | 3 | 20 | 6.9 | 219 | 28.7 | 52.6 | +1.7 | +1.4 | +0.9 |
| 5 | 5 | 10 | 4.2 | 410 | 30.5 | 54.6 | +1.9 | +1.5 | +1.0 |
| 10 | 3 | 10 | 6.8 | 220 | 28.7 | 51.0 | +1.5 | +1.3 | +1.1 |
| 80 | 3 | 10 | 8.5 | 183 | 29.0 | 52.0 | +0.5 | +0.4 | +0.3 |

From the results of Table 1, it is found that the samples according to the present invention are markedly improved in respect of scent, taste and peculiarity, compared with the controls free from flavoring and treated at a temperature of as high as 80° C. and, especially, have the flavor peculiar to the Burley type tobacco. This feature was most prominent when extraction was carried out for 10 minutes with cold water of 5° C. in a quantity 3 times as much as the amount of the raw material.

It is to be understood that, when the solid-to-liquid ratio is 1, any extracted liquid is not obtained, since the raw material merely swells.

EXAMPLE 2

In an extractor, 100 grams of Burley type ABR-No. 8 produced in U.S.A. were extracted for 10 minutes with water of 5° C. in a quantity three times by weight the amount of the raw material, followed by separation of the extracted liquid by means of a centrifuge. In a rotary evaporator, the thus obtained liquid was concentrated under reduced pressure to a solute concentration of 30–50% at a temperature of 40°–60° C. and with an effective temperature difference of 10°–30° C.

The resulting extracts were diluted 10–17 times with water. In the same manner as in Example 1, the diluted liquid was sprayed onto a cut tobacco sheet made by a papermaking process in a proportion of 0.1% as solute concentration, and the sheet was formed into sample cigarettes. These samples, together with a control free from flavoring, were subjected to 20—professional panelist organoleptic tests relying upon two-point comparison, the results of which are shown in Table 2.

TABLE 2

| Concentration Conditions | | | | Estimation (average) | | |
|---|---|---|---|---|---|---|
| Temperature | Effective Temp. Dif. (°C.) | Concentration (%) | Time (min) | Scent | Taste | Peculiarity |
| Flavoring-free Sample | | | | 0 | 0 | 0 |
| 60 | 30 | 34.0 | 67 | +0.9 | +0.7 | +0.5 |
| 60 | 25 | 61.0 | 50 | +0.4 | +0.6 | +0.3 |
| 50 | 30 | 32.0 | 55 | +1.3 | +1.0 | +0.8 |
| 40 | 30 | 31.3 | 40 | +1.5 | +1.4 | +1.1 |
| 40 | 30 | 33.6 | 84 | +1.3 | +1.1 | +0.9 |
| 40 | 20 | 33.9 | 57 | +2.1 | +1.5 | +1.3 |
| 40 | 10 | 30.0 | 55 | +2.8 | +2.2 | +1.8 |
| 40 | 10 | 30.8 | 107 | +2.5 | +1.6 | +1.2 |
| 40 | 10 | 40.5 | 65 | +1.9 | +1.4 | +1.0 |

From the results of Table 2, it is found that the samples according to the present invention are improved in respect of scent, taste and peculiarity, compared with the control. The flavor peculiar to the Burley type tobacco was most prominently imparted to the sample, when the concentration temperature, the effective temperature difference and the solute concentration were 40° C., 10° C. and 30%, respectively. When the concentration temperature and the solute concentration were higher than 50° C. and 40%, respectively, the flavor peculiar to the Burley type tobacco was unlikely added to the samples.

It has also been found that the shorter the concentration time, the greater the effect.

EXAMPLE 3

100 grams of Burley type ABR-No. 8 produced in U.S.A. were extracted under the conditions as given in Example 2. After freezing at −13° C., the extracted liquid was dried under a degree of vacuum of 50 mmHg. The final temperatures which the resulting powders reached were 20, 40 and 60° C. In this manner, about 15 grams of powders having a moisture content of 3–8% (on the dried basis, the same shall apply hereinafter) were produced.

The dried powders were dissolved in water in a quantity about 20 times as much as the amount thereof, and the thus obtained liquid was uniformly sprayed onto a cut tobacco sheet made by a paper-making process in a proportion of 20 g/kg (0.1% as solute concentration).

To prepare a control, on the other hand, the foregoing extracted liquid was concentrated under reduced pressure at a temperature of 40° C. and with an effective temperature difference of 10° C. in a rotary evaporator. The resulting extract having a concentration of 30% was diluted 6 times with water, and was sprayed onto a cut tobacco sheet made by a paper-making process in a proportion of 20 g/kg (0.1% as solute concentration).

The samples were formed into cigarettes in the same manner as in Example 1. These cigarettes, along with the sample according to the present, used as a control, were subjected to 20—professional panelist organoleptic tests relying upon two-point comparison, the results of which are set forth in Table 3.

TABLE 3

| Samples | | Estimation (average) | | |
|---|---|---|---|---|
| Flavoring | Drying Temperature | Scent | Taste | Peculiarity |
| Inventive Sample | — | 0 | 0 | 0 |
| Powdery Flavoring-Containing Samples | 20° C. | −1.2 | −0.8 | −0.7 |
| Powdery Flavoring-Containing Samples | 40° C. | −1.6 | −1.7 | −1.1 |
| Powdery Flavoring-Containing Samples | 60° C. | −2.0 | −1.9 | −1.5 |

From the results of Table 3, it is found that the sample according to the present invention is superior to those containing the powdery flavoring in respect of scent, taste and peculiarity, and the powdery extract gives a weakened flavor and an increased bitterness.

EXAMPLE 4

In an extractor, 100 grams of powdery yellow type BY-No. 4 produced in Japan (having a moisture content of 7.9%) were extracted for 10 minutes with water of 5° C. in a quantity three times by weight the amount of the raw material, followed by separation of the extracted liquid by a centrifuge. The thus obtained liquid was concentrated under pressure at a temperature of 40° C., thereby obtaining 64.3 grams of a concentrated extract having a concentration of 30%.

On the other hand, 100 grams of the foregoing raw material were extracted with 1 kg of methanol, followed by separation of the extracted liquid by means of a centrifuge. The thus obtained liquid was concentrated under reduced pressure at 50° C. in a rotary evaporator. Further, the aforesaid cocentrated extract was treated under pressure to obtain 42.9 grams of an extract having a concentration of 50%.

These extracts were diluted 10–20 times with water. The thus diluted liquids were uniformly sprayed onto a cut tobacco sheet made by a process akin to papermaking in a proportion of 0.1–0.2% in terms of solute concentration, which was formed into cigarettes in the same manner as in Example 1. These samples, together with a flavoring-free control, were subjected to 20—professional panelist organoleptic tests lying upon two-point comparison, the results of which are set forth in Table 4.

TABLE 4

| Kind of Extract | Added Amount (%) (as solute concentration) | Estimation (average) | | |
|---|---|---|---|---|
| | | Scent | Taste | Peculiarity |
| Flavoring-free Sample | — | 0 | 0 | 0 |
| Inventive Sample | 0.1 | +2.4 | +2.1 | +1.5 |
| Inventive Sample | 0.2 | +1.7 | +1.6 | +1.1 |
| Methanol Extracts | 0.1 | +1.3 | +1.2 | +0.4 |
| Methanol Extracts | 0.2 | +0.8 | +0.5 | +0.2 |

From the results of Table 4, it is found that both the cold water- and methanol-extracted extracts are improved in respect of scent, taste and peculiarity. Especially, the samples according to the present invention (cold water-extracted extracts) were improved in respect of the quality of flavor, and the quality of smoke and taste.

In this example, sufficient results were obtained in an amount of the flavoring of 0.1%.

EXAMPLE 5

Burley type KCL produced in U.S.A. was crushed to a length of no more than 5 mm to obtain 8 kg of a raw material having a moisture content of 12.7%. The raw material was placed together with 24 kg of cold water of 5° C. in a jacketed extractor of the agitation type, in which it was extracted for 4 minutes while being stirred at a peripheral speed of 0.6 m/sec. The extracted liquid having a concentration of 6.9% was then separated from the residue by means of a centrifuge in an amount of 19.6 kg.

The whole amount of this extracted liquid was concentrated under reduced pressure for 76 minutes at a temperature of 40° C. and with an effective temperature difference of 10° C. in an externally heating type concentrator which was of a heating area of 0.59 $m^2$ and of the forced circulation type, thereby obtaining 4.48 kg of a concentrated extract having a concentration of 30%.

On the other hand, 200 grams of the foregoing raw material were extracted with 600 grams of water of 5° C. for 10 minutes in an extractor, followed by solid-liquid separation in a centrifuge, thereby obtaining 476 grams of the extracted liquid having a concentration of 7.1%. That liquid was then concentrated under reduced pressure for 85 minutes at 40° C. and with an effective temperature difference of 10° C. in a rotary evaporator to obtain 111 grams of a concentrated extract having a concentration of 30% as a control sample.

The respective extracts were diluted 10 times with water, and were uniformly sprayed onto cut tobacco sheets obtained by papermaking in a solute concentration of 0.1%, which were wrapped up in the same manner as in Example 1. The obtained samples were subjected to 20—professional panelist organoleptic tests reyling upon two-point comparison and using as the control a flavoring-free product, the results of which are shown in Table 5.

TABLE 5

| Concentrator | Temperature Difference (°C.) | Concentration Time (min.) | Estimation (average) Scent | Taste | Peculiarity |
|---|---|---|---|---|---|
| Flavoring-free Sample | — | — | 0 | 0 | 0 |
| Rotary Evaporator | 10 | 85 | +2.6 | +2.8 | +2.3 |
| Externally Heating Device | 10 | 76 | +2.5 | +2.6 | +2.1 |

From the results of Table 5, it is found that the inventive flavoring formulations extracted in the jacketed extractor of the agitation type and prepared in the externally heating type concentrator are prominently improved in respect of scent, taste and peculiarity, as is the case with the rotary evaporator concentration used in Examples 1–5, and impart the flavor peculiar to the kind of tobacco used.

EXAMPLE 6

By the addition of water, re-dried Burley type cut tobacco was regulated to a moisture content of 22%. The concentrated extract of Burley type ABR-No. 8 produced in U.S.A. and obtained in Example 3 was diluted 10 times with ethyl alcohol, and was sprayed onto that cut tobacco in an proportion of 33 g/kg (0.1% as solute concentration), which was in turn dried at 110° C. to a moisture content of 11.1% in a ventilating type dryer. According to the procedures of Example 1, the cut tobacco was wrapped up to prepare the inventive flavoring-containing samples.

In order to prepare a control sample, on the other hand, cut tobacco having a moisture content of 33.3%, to which only water was added, was similarly dried to a moisture content of 11.1% and wrapped up.

The inventive and control samples were subjected to 20—professional panelist organoleptic tests relying upon two-point comparison, the results of which are shown in Table 6.

TABLE 6

| Sample | Estimation (average) Scent | Taste | Peculiarity |
|---|---|---|---|
| Flavoring-free Sample | 0 | 0 | 0 |
| Inventive Sample | +1.3 | +2.1 | +2.2 |

From the results of Table 6, it is noted that the inventive sample is of decreased greenery smelling, bitter and pungent tastes, compared with the control sample, and are prominently improved in respect of the quality of flavor.

EXAMPLE 7

Burley type KCL produced in U.S.A. was crushed to prepare 200 grams of a raw material having a moisture content of 11.1–12.4% and a length of no longer than 5 mm. These materials were extracted with 600 grams of water of 5° C. for 10 minutes, followed by solid-liquid separation in a centrifuge to obtain 460 grams of KCL extracted liquids having a concentration of 2.7%. Each KCL liquid was concentrated under reduced pressure at a temperature of 40° C. and with an effective temperature difference of 10° C. in a rotary evaporator to obtain 115 grams of a concentrated KCL extract of 30%. The concentrated extract was mixed with a 87% glycerin solution or propylene glycol solution to prepare a flavoring formulation having an extract solute concentration of 10% or 20%.

The concentrated extracts and the relative flavoring formulations were stored in a refrigerator to examine the flavoring effect and the physical properties of flavoring so as to investigate the changes in quality during storage.

The extracts and the flavoring formulations were diluted 5–20 times with water, and the flavoring formulations were sprayed onto cut tobacco sheets obtained by paper-making in a solute concentration of 0.1%.

The aforesaid cut tobacco was wrapped up in the same manner as in Example 1 to prepare the inventive samples. Flavoring-free cut tobacco was similarly wrapped up to prepare a control sample. These samples were subjected to 20—professional panelist organoleptic tests relying upon two-point comparison, the results of which are set forth in Table 7. Table 8 also shows the results of measurements of the specific gravity, pH, viscosity and the number of bacterium of the flavoring formulations during or after 3 months of formulation.

TABLE 7

| Kind of Flavoring: Raw Material | Additive | Extract Solute Concentration (%) | Month | Estimation (average) Scent | Taste | Peculiarity |
|---|---|---|---|---|---|---|
| Flavoring- | — | — | — | 0 | 0 | 0 |

TABLE 7-continued

| Kind of Flavoring | | Extract Solute Concentration (%) | Month | Estimation (average) | | |
|---|---|---|---|---|---|---|
| Raw Material | Additive | | | Scent | Taste | Peculiarity |
| free Sample KCL | — | 28.9 | 0 | +2.6 | +2.8 | +2.3 |
| | Glycerin | 10 | 3 | +2.5 | +2.9 | +2.2 |
| | | 20 | 3 | +2.6 | +2.8 | +2.2 |
| | P. G. | 10 | 3 | +2.4 | +2.5 | +2.1 |

TABLE 8

| Kind of Flavoring | | Extract Solute Concentration (%) | Month | Specific Gravity ($d_4^{20}$) | $p^H$ | Viscosity (CP) | Number of Bacterium/ml | Number of Fungi/ml |
|---|---|---|---|---|---|---|---|---|
| raw material | additive | | | | | | | |
| KCL | Glycerin | 10 | 0 | 1.211 | 5.59 | 27.7 | $2.72 \times 10^5$ | 230 |
| | | 10 | 3 | 1.209 | 5.60 | 28.0 | $2.50 \times 10^5$ | — |
| | | 20 | 0 | 1.177 | 5.48 | 8.6 | $5.53 \times 10^5$ | 490 |
| | | 20 | 3 | 1.178 | 5.48 | 9.0 | $5.08 \times 10^5$ | — |
| | P. G. | 10 | 0 | 1.085 | 5.95 | 79.5 | $2.06 \times 10^5$ | — |
| | | 10 | 3 | 1.088 | 5.98 | 72.3 | $1.25 \times 10^5$ | — |

From the results of Table 7, it is appreciated that, in 3-month storage at 5° C., the flavoring effect of the formulations upon scent, taste and peculiarity is practically equal to that of the extracts just after preparation, so that the flavor peculiar to the kind of tobacco is maintained.

From the results of Table 8, it is also appreciated that the physical properties such as specific gravity, pH and viscosity do not substantially vary during storage, and the number of bacterium tend to decrease slightly, which shows no sign of deterioration during storage.

EXAMPLE 8

Re-dried tobacco of No. 2 native kind was crushed to prepare 200 grams of a raw material having a moisture content of 11.6% and a length of no longer than 5 mm. As is the case with Example 7, this material was extracted at 5° C., and concentrated under reduced pressure at 40° C. to obtain 139 grams of a concentrated extract having a concentration of 30%. This extract was mixed with a two-fold amount of 87% glycerin to prepare a flavoring formulation having an extract solute concentration of 10%.

This formulation was diluted 10 times with water, and sprayed onto a cut tobacco product in a proportion of 1 g/kg (0.01% as solute concentration) to prepare an inventive product, which was wrapped up in the same manner as in Example 1 to obtain the inventive sample. A flavoring-free tobacco product was similarly wrapped up to prepare a control sample. The inventive and control samples were subjected to 20—professional panelist organoleptic tests relying upon two-point comparison, the results of which are set forth in Table 9.

TABLE 9

| Sample | Estimation (average) | | |
|---|---|---|---|
| | Scent | Taste | Peculiarity |
| Flavoring-free Sample | 0 | 0 | 0 |
| Inventive Sample | +1.9 | +2.4 | +1.6 |

From the results of Table 9, it is understood that the inventive sample is improved in respect of scent, taste and peculiarity, compared with the control sample, and are especially improved in respect of the quality of flavor and smoke.

EXAMPLE 9

Burley type KCS produced in U.S.A. was crushed to prepare 9 kg of a raw material having a moisture of 11.6% and a length of no longer than 5 mm. This material was extracted and concentrated in the same manner as in Example 5 to obtain 4.2 kg of a concentrated extract having a concentration of 30%. This extract was mixed with a twofold amount of 89% glycerin to prepare a flavoring formulation having an extract solute concentration of 10%.

This formulation was added to a concentrated liquid (in a solute concentration of 0.08% with respect to product) in the process of the production of sheet tobacco by papermaking and, thereafter, was coated onto a base sheet. The resulting sheet was wrapped up in the same manner as in Example 1 to prepare the inventive sample.

Flavoring-free cut tobacco was similarly wrapped up to prepare a control sample. These inventive and control samples were subjected to 20—profesional panelist organoleptic tests relying upon two-point comparison, the results of which are shown in Table 10.

TABLE 10

| Sample | Estimation (average) | | |
|---|---|---|---|
| | Scent | Taste | Peculiarity |
| Flavoring-free Sample | 0 | 0 | 0 |
| Inventive Sample | +2.9 | +2.9 | +2.2 |

From the results of Table 10, it is understood that the inventive sample possesses the increased flavor peculiar to the Burley kind, and is improved in respect of scent, taste and peculiarity, compared with the control sample.

EXAMPLE 10

According to the procedures of Example 7, concentrated extracts were prepared using as the raw material yellow type OCS and OCH and Burley type KCS and KCL produced in U.S.A. The extracts were mixed with a 87% glycerin solution to prepare four flavoring formulations having an extract solute concentration of 10%.

The formulations were mixed together in the ratio as specified in Table 11, and diluted 20 times with water.

TABLE 11

| Flavoring | OCS | OCH | KCS | KCL |
|---|---|---|---|---|
| Ratio | 35 | 15 | 35 | 15 |

The thus diluted liquid was applied to low-nicotine and -tar cigarettes having a circumference of 25 mm, a length of 85 mm, a 25 mm-filter portion and a row of perforations in an amount of 10 μl a cigarette by means of a microcylinder. The control sample used was a flavoring-free one. These samples were subjected to 20—professional panelist organoleptic tests relying upon two-point comparison, the results of which are shown in Table 12.

TABLE 12

| Sample | Estimation (average) | | |
|---|---|---|---|
| | Scent | Taste | Peculiarity |
| Flavoring-free Sample | 0 | 0 | 0 |
| Inventive Sample | +2.6 | +2.3 | +1.4 |

From the results of Table 12, it is understood that the inventive sample is markedly improved in respect of scent, taste and peculiarity, compared with the control sample, and is especially of decreased weakeness, unlike the control sample, as well as of increased flavor, an increased amount of smoke and gives a satisfactory feeling of satisfaction.

What is claimed is:

1. A process for preparing a tobacco flavoring formulation extract which comprises extracting tobacco leaves having a moisture content of 7.9 to 12.7% by weight with cold water at a temperature of 0°–10° C. in a quantity of one to five times by weight of water to obtain a liquid extract by solid-liquid separation and concentrating the extract at a concentration temperature of 30°–50° C. to produce a solute concentration of 25–35% by weight and recover a concentrated extract.

2. A process as defined in claim 1, in which said cold water is at a temperature of 5° to 10° C.

3. A process as defined in claim 1, in which said concentration temperature is 40° to 50° C.

4. A process as defined in claim 1, in which said extraction is performed for 4 to 20 minutes.

* * * * *